US006213224B1

(12) United States Patent
Furuta et al.

(10) Patent No.: US 6,213,224 B1
(45) Date of Patent: Apr. 10, 2001

(54) ELECTRIC POWER TOOL WITH ENHANCED STRENGTH TO AXIALLY-APPLIED EXTERNAL FORCE

(75) Inventors: Takefumi Furuta, Anjo; Shingo Umemura, Okazaki; Shinsuke Mori, Takahama, all of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/334,352

(22) Filed: Jun. 16, 1999

(30) Foreign Application Priority Data

Jun. 17, 1998 (JP) ..... 10-170304

(51) Int. Cl.[7] ..... E21B 3/00

(52) U.S. Cl. ..... 173/217; 173/170; 173/216

(58) Field of Search ..... 173/217, 216, 173/171; 310/176, 170, 47, 50; 408/241 R

(56) References Cited

U.S. PATENT DOCUMENTS

| | | | | |
|---|---|---|---|---|
| 3,491,840 | * | 1/1970 | Haviland et al. | 173/216 |
| 3,734,207 | * | 5/1973 | Fishbein | 173/217 |
| 3,829,721 | * | 8/1974 | Rosenthal, Jr. | 310/47 |
| 3,908,139 | * | 9/1975 | Duncan, Jr. | 173/217 |
| 3,959,677 | * | 5/1976 | Grieb | 310/50 |
| 4,366,403 | * | 12/1982 | Simpson et al. | 310/50 |
| 4,479,555 | * | 10/1984 | Grossman et al. | 173/171 |
| 4,730,134 | * | 3/1988 | Sistare | 310/50 |
| 5,049,012 | * | 9/1991 | Cavedo | 408/241 R |
| 5,339,908 | * | 8/1994 | Yokota et al. | 173/216 |
| 5,531,278 | * | 7/1996 | Lin | 173/216 |
| 5,624,000 | * | 4/1997 | Miller | 173/217 |

FOREIGN PATENT DOCUMENTS

| | | |
|---|---|---|
| 59-52298 | 12/1984 | (JP) . |
| 4-59112 | 9/1992 | (JP) . |

* cited by examiner

*Primary Examiner*—Peter Vo
*Assistant Examiner*—Jim Calve
(74) *Attorney, Agent, or Firm*—Foley, Hoag & Eliot LLP

(57) ABSTRACT

An electric power tool is provided including a main housing (2) assembled by fitting together right and left casing halves (3, 4), a drive unit (5), a spindle (14) coupled to the drive unit, and a change ring (20). The drive unit includes a DC motor (6), a gear assembly (7), and first and second gear cases (9, 15). The aluminum-alloy second gear case (15) is provided with a connecting portion (17) which has an outer shape that smoothly and continuously connects with the front end of the main housing and which is secured to the main housing by four screws (24) in the axial direction toward the rear portion of the tool. In addition, the second gear case includes a small-diameter journal bearing (16) which extends forwardly from the front end of the connecting portion (17) within the change ring so as to support the spindle of the tool.

15 Claims, 3 Drawing Sheets

ELECTRIC POWER TOOL WITH ENHANCED STRENGTH TO AXIALLY-APPLIED EXTERNAL FORCE

This application claims priority on Japanese Patent Application No. 10-170304, the contents of which are incorporated herein by reference.

BACKGROUND OF THE INVENTION

1. Field of the Invention

The present invention relates to electric power tools. More particularly, the present invention relates to an electric power tool which has a split two-part housing for encasing a drive unit that includes a motor and a reduction mechanism for transmitting the rotation of the motor to a spindle protruding toward the top end of the tool.

2. Description of the Related Art

Various power screwdrivers and screwdriver/drills have been known in the art, as disclosed in Japan Published Examined Patent Application Nos. S59-52298 and H4-59112, both of which include a description of a split two-part housing made of synthetic resin that encloses a drive unit. Furthermore, the drive unit includes a motor and a reduction mechanism which is coupled to the motor by means of screws and transmits the rotation of the motor to a spindle protruding toward the top end of the housing. Additionally, a torque setting adjuster and a chuck are mounted on the part of the spindle protruding from the front of the housing.

When this arrangement is applied to an electric power screwdriver as in the above examples, the tool is subjected to a large force acting in the axial direction of the spindle when the tool bit is pressed against a screw or other workpiece. The split two-part housing made of synthetic resin sometimes fails to withstand the force, with the result being that the spindle and the housing become distorted or warped. This may in turn adversely affect gear engagement in the reduction mechanism and thus normal rotation of the spindle.

SUMMARY OF THE INVENTION

In view of the above-identified problems, an important object of the present invention is to provide an electric power tool with sufficient rigidity such that the tool can effectively withstand a large axial force applied thereto.

Another object of the present invention is to provide an electric power tool that can maintain normal rotation of the spindle when subjected to a large axial force.

The above objects and other related objects are realized by the invention, which provides an electric power tool, comprising: a spindle having an axis; a drive unit including a motor and a reduction mechanism for transmitting the rotation of the motor to the spindle of the tool; and a housing having a front end for containing the drive unit. In this tool, a portion of the drive unit is made of metal, with the metal portion of the drive unit exposed to the outside of the tool forward of the housing and connected to the front end of the housing. This construction imparts to the tool enhanced rigidity, particularly strength to external force applied in the axial direction, thus preventing the housing from twisting or deforming during operation. In addition, proper engagement, in the reduction mechanism is ensured so as to maintain normal torque transmission.

According to one aspect of the present invention, the metal portion of the drive unit is screwed to the front end of the housing in the axial direction of the spindle. This construction renders the drive unit strong enough to withstand axial external force applied to the unit.

According to another aspect of the present invention, the metal portion of the drive unit is integrally provided with a bearing portion for supporting the spindle. The integral metal bearing portion rigidly supports the spindle such that the spindle does not, easily twist or warp.

According to still another aspect of the present invention, the reduction mechanism is an epicycle reduction gear mechanism, and the drive unit includes a clutch means for interrupting the transmission of the rotation of the motor from the epicycle reduction gear mechanism to the spindle responsive to a load applied to the spindle.

According to yet another aspect of the present invention, the clutch means includes an adjusting member for adjusting the torque at which the transmission of the motor rotation to the spindle is interrupted. Furthermore, the metal portion of the drive unit is disposed between the adjusting member and the housing.

In accordance with another aspect of the present invention, the metal portion of the drive unit has a substantially cylindrical shape, and the tool optionally includes an auxiliary handle with a circular mount that can be fitted around the metal portion of the drive unit.

In a preferred embodiment, the metal portion of the drive unit may have an outer surface that is smoothly and continuously connected with an outer surface of the front end of the housing.

In another preferred embodiment, the metal portion of the drive unit is made of aluminum alloy.

To carry out the invention in one preferred mode, the housing further includes two substantially symmetrical casing halves fitted together in a plane in which the axis of the spindle is located.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment according to the present invention will be described hereinafter with reference to the attached drawings.

Figure 1:
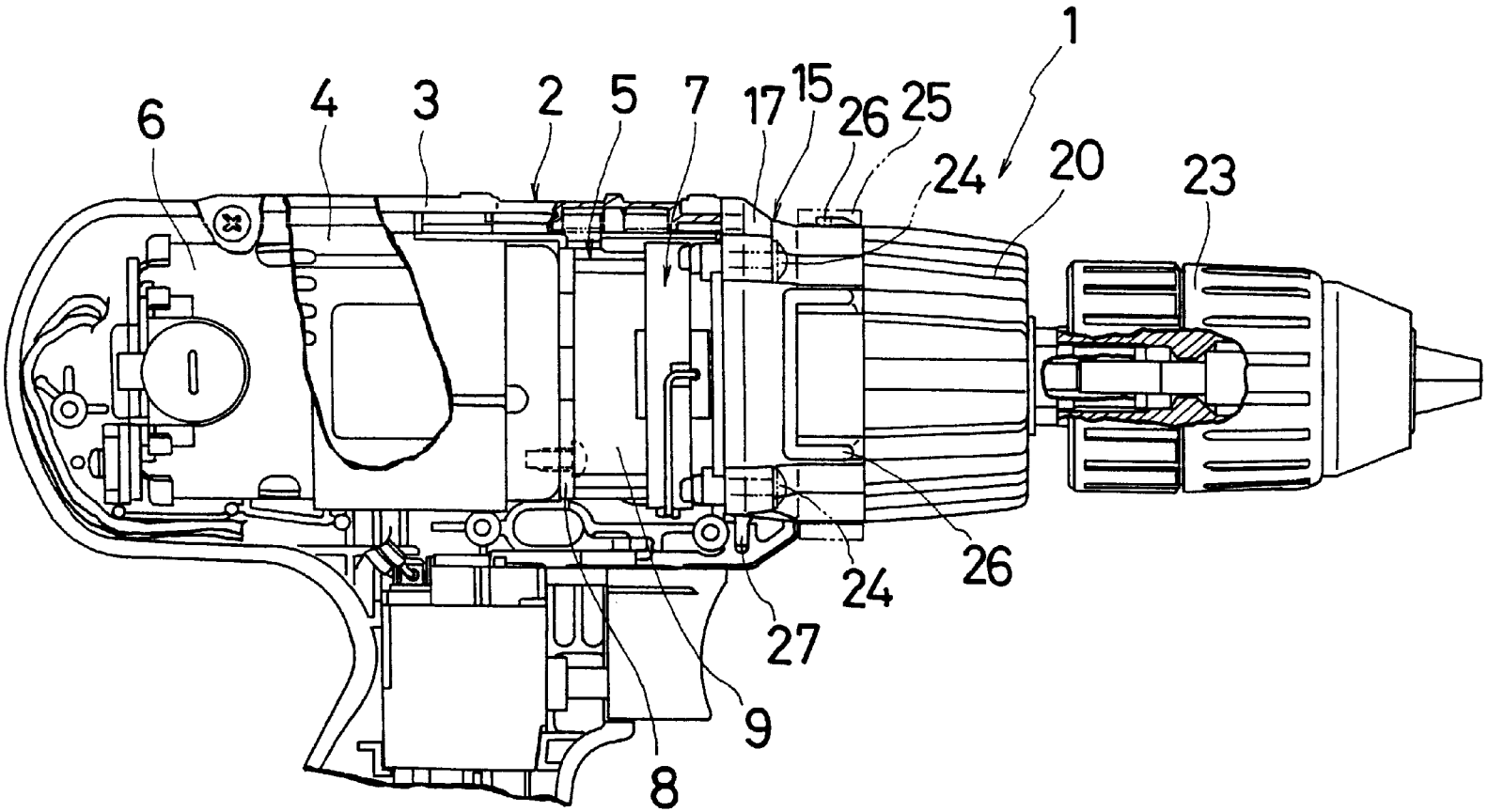
FIG. 1 is a partially cross-sectional side view of an essential part of an electric power screwdriver/drill according to the present invention.
Figure 2:
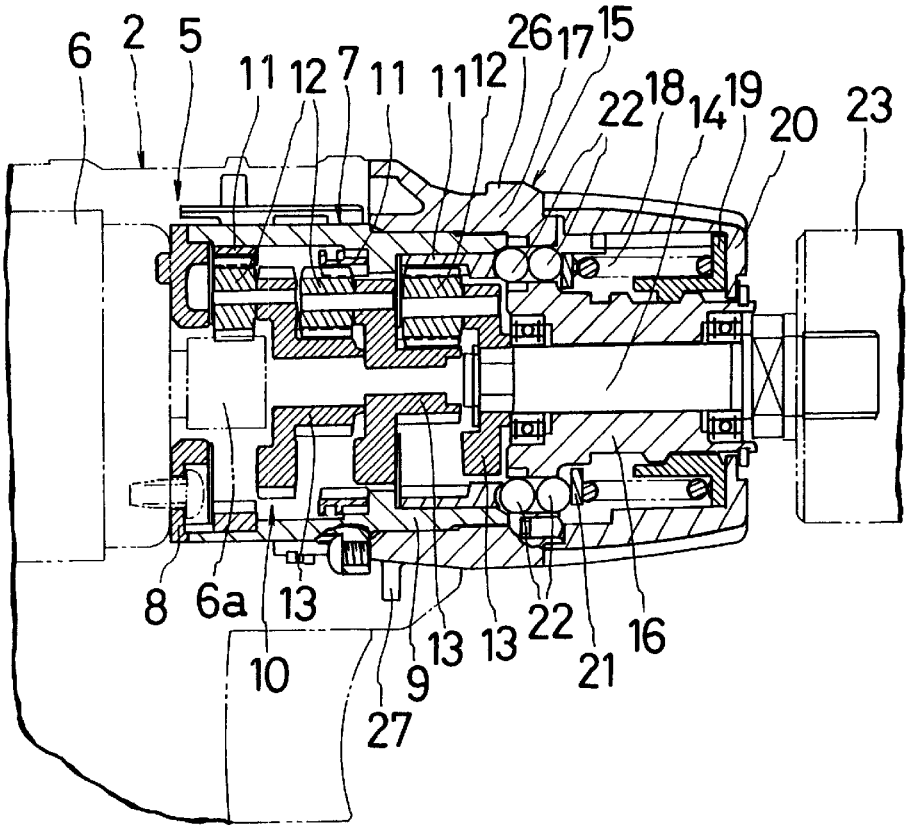
FIG. 2 is a cross-sectional view of the gear assembly of the electric power screwdriver/drill of FIG. 1.

FIG. 1 is a partially cross-sectional side view of an essential part of an electric power screwdriver/drill 1 which embodies the present invention. The screwdriver/drill 1 includes two split casing halves 3 and 4 screwed together to constitute a main housing 2. Enclosed within the main housing 2 is a drive unit 5 comprising a DC motor 6 and a gear assembly 7 disposed in front of (to the right in the drawing), and coupled to the DC motor 6. As shown in FIG. 2, the drive unit 5 further includes a cylindrical first gear case 9 which is secured to the front of a motor bracket 8 of the gear assembly 7. The motor bracket 8 is screwed to the DC motor 6. In addition, the DC motor 6 has a motor shaft 6*a* which protrudes into the first gear case 9. The rotation of the motor shaft 6*a* is transmitted to a spindle 14 of the tool 1 via a epicycle reduction gear mechanism 10 that includes three stages of an internal gear 11, a planetary gear 12, and a carrier 13, to which the gear 12 is coupled.

The drive unit 5 further includes a second gear case 15 secured to the front of the first gear case 9. The second gear case 15 is a molded aluminum alloy component, including a small-diameter journal bearing 16 supporting the spindle 14 and a large-diameter connecting portion 17 which extends rearward from the journal bearing 16 and covers the front end of the first gear case 9. A change ring 20 is fitted over the journal bearing 16 for rotatably operating a spring holder 19 that retains the front, end of a spring 18 mounted around the journal bearing 16. The rear end of the spring 18 presses against and secures the front internal gear 11 by means of a flat washer 21 and two tiers of balls 22. When the change ring 20 is manually rotated so as to screw-feed the spring holder 19 in the axial direction of the journal bearing 16, the force fixing the internal gear 11 can be adjusted so as to control the torque corresponding to the load applied to the spindle 14 at which the internal gear 11 starts to rotate idly. Reference numeral 23 indicates a drill chuck mounted at the front end of the spindle 14.

Figure 3:
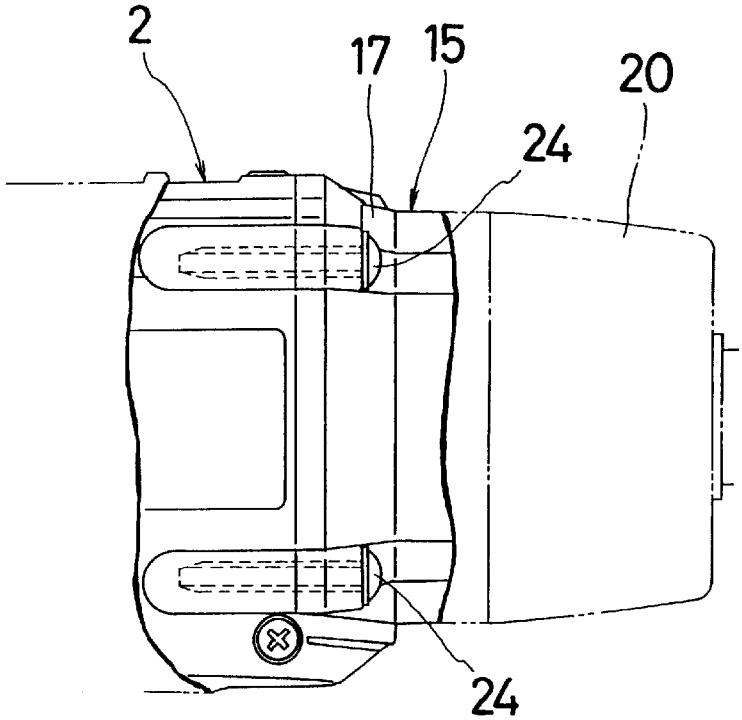
FIG. 3 is an enlarged view of a portion of the electric power screwdriver/drill of FIG. 1, showing the connection of the second gear case to the main housing.

The external shape of the connecting portion 17 of the second gear case 15 is formed such that the connecting portion 17 connects smoothly and continuously with the exterior of the front end of the main housing 2. As shown in FIG. 3, the connecting portion 17 is secured to the main housing 2 by means of four screws 24 in the axial direction toward the rear portion of the tool during assembly. This also secures the drive unit 5 to the main housing 2, exposing for manual access the connecting portion 17 as well as the change ring 20 to the outside of the electric power tool 1 in front of the main housing 2. Referring again to FIG. 1, a circular mount 25 of an auxiliary handle can be fitted around the connecting portion 17. When the auxiliary handle is attached, protrusions 26 formed on the outer surface of the connecting portion 17 engage detent protrusions (not shown) formed on the inner surface of the circular mount 25 so as to prevent the rotation of the circular mount 25. Reference numeral 27 is an alignment piece fitted in the inner surface of the main housing 2 in order to position the second gear case 15 relative to the main housing 2 during assembly.

As described above, since the metal second gear case 15 is exposed and directly connected to the front end of the split main housing 2, the electric power screwdriver/drill 1 is provided with increased rigidity, making it strong enough to withstand external force applied to the tool, especially in the axial direction. Accordingly, the main housing 2 does not twist or deform when the tool bit is pressed against a workpiece with a large force to tighten screws or to drill holes, thus maintaining precise gear engagement in the epicycle reduction gear mechanism 10. This also ensures proper transmission of torque to the spindle 14. In addition, the drive unit 5 remains properly secured to the main housing 2 via the second gear case 15.

Furthermore, as the second gear case 15 is secured to the main housing 2 by the screws 24 in the axial direction of the spindle 14, the second gear case 15 is connected to the main housing 2 with a sufficiently high rigidity to withstand axial external force. Neither does the spindle 14, rigidly supported by the journal bearing 16 of the second gear case 15, easily become deformed or twisted. Since an auxiliary handle can be attached to the exposed second gear case 15, the operability and the work efficiency of the electric power screwdriver/drill 1 are not only greatly enhanced, but the auxiliary handle itself can also be more securely attached to the tool due to the strength of the metal gear case 15.

In the above-described embodiment, the drive unit 5 integrates the DC motor 6 and the gear assembly 7. However, the present invention is applicable to a tool in which a motor and a gear assembly may be separately assembled.

A person of ordinary skill in the art will also appreciate that the second gear case 15 need not be connected to the main housing 2 in the manner described above. Any change or alteration in the design can be made to suit any particular application. Depending on the design of the reduction mechanism 10, the connecting portion 17 of the gear case 15, for example, may have a larger diameter than that of the front end of the main housing 2 so that the connecting portion 17 partially covers the main housing 2. Alternatively, the connecting portion 17 of the gear case 15 may have a smaller diameter than that of the front end of the main housing 2 so that the main housing 2 partially covers the connecting portion 17. In the above embodiment, the second gear case 15 is connected to the main housing 2 by the axially extending screws 24; however, other means may be adopted and/or the direction of the screws can be changed to match the external force likely to be applied to the tool 1.

Those skilled in the art will also appreciate that the present invention is applicable to tools, including but not limited to electric screwdrivers and drills, other than electric screwdriver/drills as in the foregoing embodiment, so long as they are of the type in which a reduction mechanism is held between and encased in right, and left casing halves.

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. An electric power tool, comprising:

a spindle having an axis;

a drive unit including a motor and a reduction mechanism for transmitting the rotation of the motor to the spindle of the tool, the reduction mechanism being an epicycle reduction gear mechanism, the drive unit including a clutch means for interrupting transmission of the rotation of the motor from the epicycle reduction gear mechanism to the spindle responsive to a load applied to the spindle, the clutch means including an adjusting member for adjusting the torque at which the transmission of the motor rotation to the spindle is interrupted; and a housing for containing the drive unit, the housing having a front end, wherein a portion of the drive unit is made of metal, the metal portion of the drive unit being exposed to the outside of the tool forward the housing and the metal portion of the drive unit being connected directly to the front end of the housing, the metal portion of the drive unit being disposed along the spindle axis between the adjusting member and the housing.

2. An electric power tool in accordance with claim 1, wherein the metal portion of the drive unit is screwed to the front end of the housing in the axial direction of the spindle.

3. An electric power tool in accordance with claim 2, wherein the metal portion of the drive unit is integrally provided with a bearing portion for supporting the spindle.

4. An electric power tool in accordance with claim 2, wherein the housing further includes two substantially symmetrical casing halves fitted together in a plane in which the axis of the spindle is located.

5. An electric power tool in accordance with claim 3, wherein the housing further includes two substantially symmetrical casing halves fitted together in a plane in which the axis of the spindle is located.

6. An electric power tool in accordance with claim 1, wherein the metal portion of the drive unit has a substantially cylindrical shape, and further wherein the tool optionally comprises an auxiliary handle with a circular mount that can be fitted around the metal portion of the drive unit.

7. An electric power tool in accordance with claim 6, wherein the metal portion of the drive unit has an outer surface that is smoothly and continuously connected with an outer surface of the front end of the housing.

8. An electric power tool in accordance with claim 7, wherein the metal portion of the drive unit is made of aluminum alloy.

9. An electric power tool in accordance with claim 6, wherein the housing further includes two substantially symmetrical casing halves fitted together in a plane in which the axis of the spindle is located.

10. An electric power tool in accordance with claim 7, wherein the housing further includes two substantially symmetrical casing halves fitted together in a plane in which the axis of the spindle is located.

11. An electric power tool in accordance with claim 8, wherein the housing further includes two substantially symmetrical casing halves fitted together in a plane in which the axis of the spindle is located.

12. An electric power tool in accordance with claim 1, wherein the housing further includes two substantially symmetrical casing halves fitted together in a plane in which the axis of the spindle is located.

13. An electric power tool in accordance with claim 1, further comprising a journal bearing portion integrally provided within the metal portion, the journal bearing portion having one or more bearings for supporting the spindle, the bearings being provided on an inner surface of the journal bearing portion.

14. An electric power tool in accordance with claim 1, wherein the housing further comprises a gear case surrounding the reduction mechanism, and wherein the metal portion covers a portion of the gear case.

15. An electric power tool, comprising:

a spindle having an axis;

a drive unit including a motor, a reduction gear mechanism for transmitting the rotation of the motor to the spindle of the tool, a clutch means for interrupting transmission of the rotation of the motor from the reduction gear mechanism to the spindle responsive to a load applied to the spindle, the clutch means including an adjusting member for adjusting the torque at which the transmission of the motor rotation to the spindle is interrupted, and a housing for containing the drive unit, the housing having a front end, wherein the drive unit includes a first gear case enclosing the reduction gear mechanism and a metal second gear case exposed to the outside of the tool forward the housing and connected to the front end of the housing, the second gear case including a journal bearing integrally provided therein for supporting the spindle, the second gear case covering a portion of the first gear case and being disposed between the housing and the adjusting member.

* * * * *

US006213224C1

(12) EX PARTE REEXAMINATION CERTIFICATE (6750th)

United States Patent

Furuta et al.

(10) Number: US 6,213,224 C1

(45) Certificate Issued: Apr. 7, 2009

(54) ELECTRIC POWER TOOL WITH ENHANCED STRENGTH TO AXIALLY-APPLIED EXTERNAL FORCE

(75) Inventors: Takefumi Furuta, Anjo (JP); Shingo Umemura, Okazaki (JP); Shinsuke Mori, Takahama (JP)

(73) Assignee: Makita Corporation, Anjo-shi, Aichi-ken (JP)

Reexamination Request:
No. 90/008,769, Jul. 24, 2007

Reexamination Certificate for:

| | |
|---|---|
| Patent No.: | **6,213,224** |
| Issued: | **Apr. 10, 2001** |
| Appl. No.: | **09/334,352** |
| Filed: | **Jun. 16, 1999** |

(30) Foreign Application Priority Data

Jun. 17, 1998 (JP) ..... 10-170304

(51) Int. Cl.
*E21B 03/00* (2006.01)

(52) U.S. Cl. ..... 173/217; 173/170; 173/216

(58) Field of Classification Search ..... None
See application file for complete search history.

(56) References Cited

U.S. PATENT DOCUMENTS

| | | | | | |
|---|---|---|---|---|---|
| 2,545,659 | A | * | 3/1951 | Ginter | 16/426 |
| 3,090,450 | A | * | 5/1963 | Fulop | 173/109 |
| 3,396,557 | A | | 8/1968 | Moores, Jr. | |
| 3,432,703 | A | * | 3/1969 | Sheps et al. | 310/50 |
| 3,703,646 | A | * | 11/1972 | Jacyno | 310/47 |
| 5,049,012 | A | * | 9/1991 | Cavedo | 408/241 R |

FOREIGN PATENT DOCUMENTS

| | | |
|---|---|---|
| JP | 62-224584 | 10/1987 |
| JP | 7-148669 | 6/1995 |

OTHER PUBLICATIONS

Makita Cordless Screwdriver Model 6703D Instruction Manual, published Sep. 29, 1994.

Makita 1996–1997 General Catalog, published 1996.

Panasonic Cordless Professional Power Tools Brochure, published Apr. 16, 1989.

Cleco Air Tools Catalog, published 1994.

* cited by examiner

*Primary Examiner*—Glenn K. Dawson

(57) ABSTRACT

An electric power tool is provided including a main housing (2) assembled by fitting together right and left casing halves (3, 4), a drive unit (5), a spindle (14) coupled to the drive unit, and a change ring (20). The drive unit includes a DC motor (6), a gear assembly (7), and first and second gear cases (9, 15). The aluminum-alloy second gear case (15) is provided with a connecting portion (17) which has an outer shape that smoothly and continuously connects with the front end of the main housing and which is secured to the main housing by four screws (24) in the axial direction toward the rear portion of the tool. In addition, the second gear case includes a small-diameter journal bearing (16) which extends forwardly from the front end of the connecting portion (17) within the change ring so as to support the spindle of the tool.

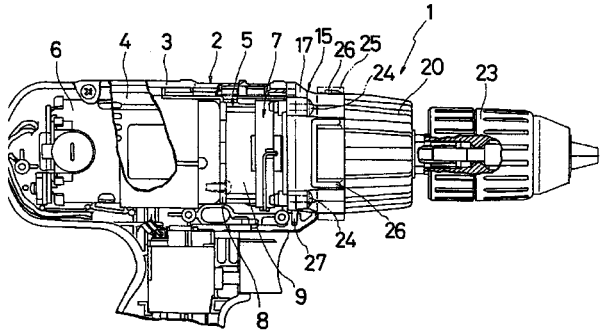

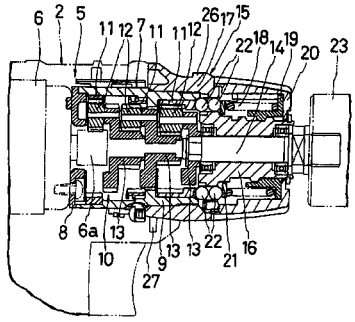

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 6, 7, 13, 14 and 15 are determined to be patentable as amended.

Claims 4, 5 and 8–12, dependent on an amended claim, are determined to be patentable.

New claims 16–23 are added and determined to be patentable.

1. An electric power tool, comprising:

a spindle having an axis;

a drive unit including a motor and a reduction mechanism for transmitting the rotation of the motor to the spindle of the tool, the reduction mechanism being an epicycle reduction gear mechanism, the drive unit including a clutch means for interrupting transmission of the rotation of the motor from the epicycle reduction gear mechanism to the spindle responsive to a load applied to the spindle, the clutch means including an adjusting member for adjusting the torque at which the transmission of the motor rotation to the spindle is interrupted; and a housing for containing the drive unit, the housing having a front end, wherein a portion of the drive unit is made of metal, the metal portion of the drive unit [being exposed to the outside of the tool forward the housing and the metal portion of the drive unit being connected directly to the front end of the housing, the metal portion of the drive unit] *including an exterior section exposed to an exterior of the tool that is directly connected to the front end of the housing and an interior section integrally cast with the exterior section, the interior section being a journal bearing portion having at least one bearing that supports the spindle, an entire outer circumferential surface of the interior section between a forwardmost at least one journal bearing and the exterior section being disposed within an interior of the tool, the interior section having an external diameter smaller than an external diameter of the exterior section, the interior section* being disposed along the spindle axis, *the external section being disposed* between the adjusting member and the housing.

2. An electric power tool in accordance with claim 1, wherein *the exterior section of* the metal portion of the drive unit is screwed to the front end of the housing in the axial direction of the spindle.

3. An electric power tool in accordance with claim 2, wherein *the exterior section of* the metal portion of the drive unit is integrally provided with [a] *the journal* bearing portion[for supporting the spindle].

6. An electric power tool in accordance with claim 1, wherein *the exterior section of* the metal portion of the drive unit has a substantially cylindrical shape, and further [wherein the tool optionally comprises an] *comprising a removable* auxiliary handle with a circular mount that can be *detachably* fitted around *the exterior section of* the metal portion of the drive unit.

7. An electric power tool in accordance with claim 6, wherein *the exterior section of* the metal portion of the drive unit has an outer surface that is smoothly and continuously connected with an outer surface of the front end of the housing.

13. An electric power tool in accordance with claim 1, [further comprising a journal bearing portion integrally provided within the metal portion, the journal bearing portion having one or more bearings for supporting the spindle,] the *at least one bearing including multiple* bearings [being] provided on an inner surface of the journal bearing portion.

14. An electric power tool in accordance with claim 1, wherein the housing further comprises a gear case surrounding the reduction mechanism, and wherein *the exterior section of* the metal portion covers a portion of the gear case.

15. An electric power tool, comprising:

a spindle having an axis;

a drive unit including a motor, a reduction gear mechanism for transmitting the rotation of the motor to the spindle of the tool, a clutch means for interrupting transmission of the rotation of the motor from the reduction gear mechanism to the spindle responsive to a load applied to the spindle, the clutch means including an adjusting member for adjusting the torque at which the transmission of the motor rotation to the spindle is interrupted, and a housing for containing the drive unit, the housing having a front end, wherein the drive unit includes a first gear case enclosing the reduction gear mechanism and a metal second gear case [exposed to the outside of the tool forward the housing and connected to the front end of the housing, the second gear case including a journal bearing integrally provided therein for supporting the spindle,] *the metal second gear case including an exterior section exposed to an exterior of the tool that is directly connected to the front end of the housing and an integral interior section integrally cast with the exterior section, the interior section including a journal bearing portion having multiple bearings integrally provided therein for supporting the spindle, an entire outer circumferential surface of the interior section between a forwardmost one of the multiple bearings and the exterior section being disposed within an interior of the tool, the multiple bearings integrally provided in the second gear case, the interior section having an external diameter smaller than an external diameter of the exterior section,* the second gear case covering a portion of the first gear case and being disposed between the housing and the adjusting member.

*16. An electric power tool according to claim 13, the multiple bearings including a forward bearing disposed at a forward end of the journal bearing portion and a rear bearing disposed at a longitudinally spaced rear end of the journal bearing portion.*

*17. An electric power tool according to claim 14, the epicycle reduction gear mechanism including multiple longitudinally spaced planetary gear stages, the exterior section of the metal portion covering only a forwardmost of the multiple planetary gear stages.*

*18. An electric power tool according to claim 1, the entire interior section being coaxial with the spindle and extending along an exterior surface of the spindle.*

*19. An electric power tool according to claim 18, the interior section being coaxial with the adjusting member, and a majority of a longitudinal length of the interior section being disposed within the adjusting member.*

*20. An electric power tool according to claim 15, the multiple bearings including a forward bearing disposed at a forward end of the journal bearing portion and a rear bearing disposed at a longitudinally spaced rear end of the journal bearing portion.*

*21. An electric power tool according to claim 20, the reduction gear mechanism being an epicycle reduction gear mechanism including multiple longitudinally spaced planetary gear stages, the exterior section of the metal second gear case covering only a forwardmost of the multiple planetary gear stages.*

*22. An electric power tool according to claim 15, the entire interior section being coaxial with the spindle and extending along an exterior surface of the spindle.*

*23. An electric power tool according to claim 22, the interior section being coaxial with the adjusting member, and a majority of a longitudinal length of the interior section being disposed within the adjusting member.*

* * * * *